US005414485A

United States Patent [19]

Fyson

[11] Patent Number: 5,414,485

[45] Date of Patent: May 9, 1995

[54] OSCILLATING DRUM FOR AN APPARATUS FOR PROCESSING PHOTOGRAPHIC MATERIALS

[75] Inventor: John R. Fyson, London, United Kingdom

[73] Assignee: Eastman Kodak Company, Rochester, N.Y.

[21] Appl. No.: 244,339

[22] PCT Filed: Nov. 25, 1992

[86] PCT No.: PCT/EP92/02709

§ 371 Date: May 27, 1994

§ 102(e) Date: May 27, 1994

[87] PCT Pub. No.: WO93/11461

PCT Pub. Date: Jun. 10, 1993

[30] Foreign Application Priority Data

Nov. 28, 1991 [GB] United Kingdom ..... 9125298

[51] Int. Cl.[6] ..... G03D 3/04

[52] U.S. Cl. ..... 354/328; 354/330; 354/329

[58] Field of Search ..... 354/316, 318–324, 354/328–331, 336, 339

[56] References Cited

U.S. PATENT DOCUMENTS

| | | | |
|---|---|---|---|
| 3,292,519 | 12/1966 | Hallquist | 354/311 |
| 3,550,521 | 12/1970 | Carrie | 354/329 |
| 3,977,876 | 8/1976 | Ratowsky | 354/328 |
| 3,981,488 | 9/1976 | Ratowsky | 354/329 |
| 4,269,501 | 5/1981 | Griffith et al. | 354/323 |
| 4,302,092 | 11/1981 | Ashton et al. | 354/329 X |
| 4,613,223 | 9/1986 | Cherry et al. | 354/322 |

*Primary Examiner*—D. Rutledge

*Attorney, Agent, or Firm*—Nixon, Hargrave, Devans & Doyle

[57] ABSTRACT

It is known to oscillate hollow processing drums to increase the agitation of the processing within the drum. However, these drums require a relatively large amount of processing solution to operate effectively, and are therefore unsuitable for unstable and/or single use processing chemistry. Described herein is a drum arrangement in which a drum oscillates within a generally u-shaped vessel, a processing tank being defined between the drum and the vessel. Photographic material is driven through the tank by a pair of drive rollers situated at the inlet to the tank. The drum is oscillated through an angle between 5° and 90° for effective processing.

6 Claims, 1 Drawing Sheet

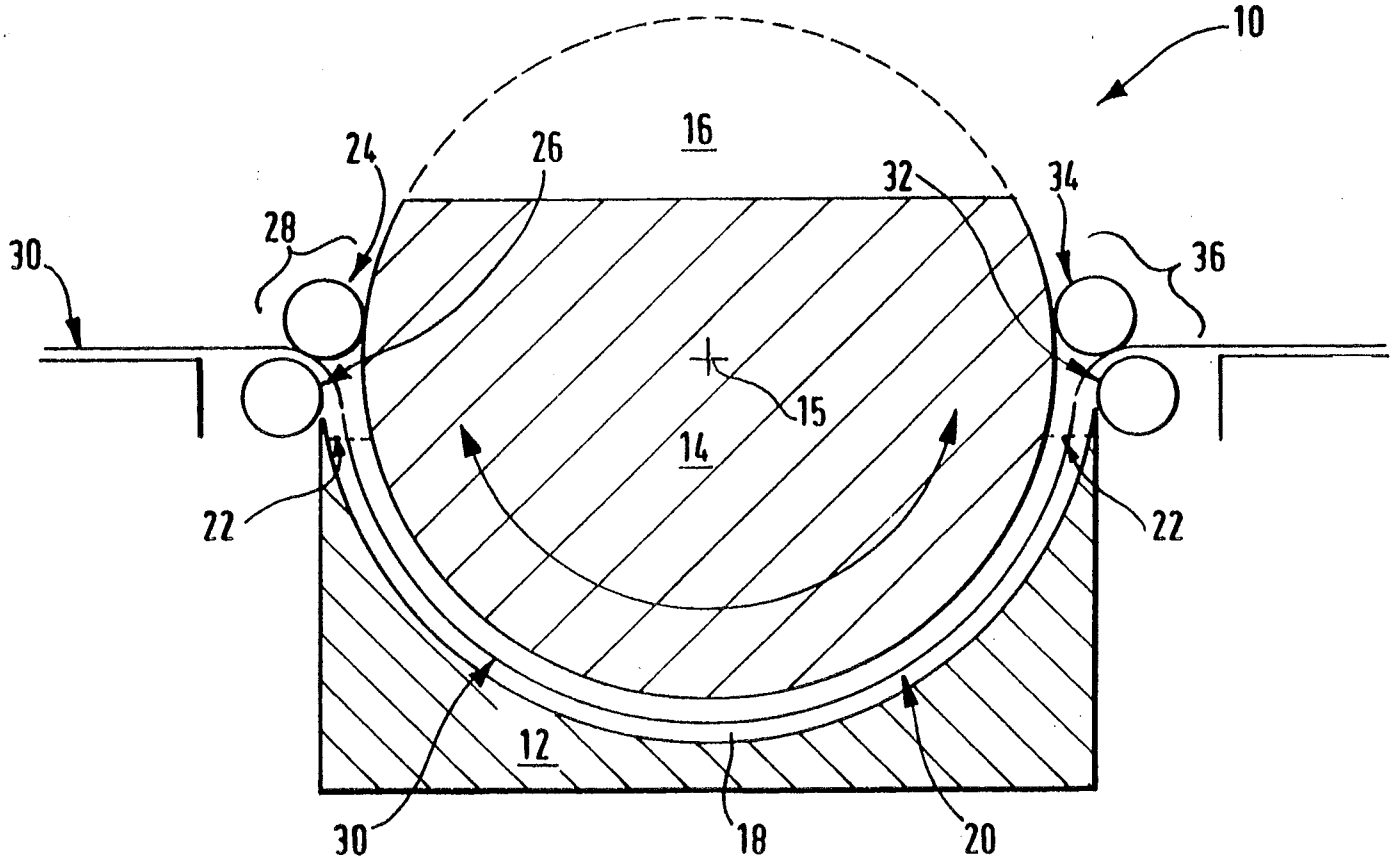
10
36
34
32
22
20
18
15
16
14
12
26
24
28
22
30
30

OSCILLATING DRUM FOR AN APPARATUS FOR PROCESSING PHOTOGRAPHIC MATERIALS

BACKGROUND OF THE INVENTION

This invention relates to photographic processing apparatus and is more particularly concerned with the processing of photographic materials using low volumes of processing solution.

Rotating drum arrangements are well-known for the processing of photographic material. U.S. Pat. No. 4,613,223 discloses an arrangement in which a flexible sheet of photographic material is driven along an endless curved path within a processing tank by passing the sheet through nips formed between at least one pair of driven rollers. At least one of the driven rollers is the drum itself. During processing, the emulsion (sensitive) surface of the sheet is arranged not to come into contact with any stationary part of the processing vessel as it is being processed. This prevents damage to the surface during processing. After driving the sheet around the endless path for a predetermined number of cycles, which defines the processing time, the sheet is then directed out of the processing tank.

The arrangement described above, has the disadvantage that little or no agitation is applied to the emulsion surface of the photographic material being processed. This may result in uneven processing of the material and variable sensitometry.

It is known to provide rotating drum arrangements in which a secondary oscillatory motion is applied to the drum to improve agitation of the processing solutions.

U.S. Pat. No. 4,302,092 discloses a hollow rotating drum mounted in a support in which material to be processed is placed with processing solution inside the drum. The drum is axially slidable relative to the support and is driven by a hand crank against the action of a soft spring. During rotation of the drum, it is displaced axially relative to the support against the soft spring to cause the processing solution inside the drum to oscillate axially.

U.S. Pat. No. 3,981,488 discloses an arrangement in which a hollow cylindrical processing tank is mounted on a support for rotation. A disc is eccentrically mounted on a drive shaft at one end of the support to provide a vertical oscillating motion to the tank at one end.

U.S. Pat. No. 3,977,876 discloses a rotating drum arrangement in which oscillatory motion is provided by the engagement of an oblique slot with a roller or a circumferential rib, the slot either being carried by the drum itself or by the base on which the drum is mounted. In either case, an axial oscillatory motion is applied to the drum as it is rotated.

U.S. Pat. No. 3,595,156 discloses an arrangement in which film to be processed is held inside a vat surrounding a cylinder. The cylinder has ribs formed on its surface to provide agitation to the processing solution in the vat. The cylinder may be driven in at a predetermined uniform cyclic speed or can be over variable speed either in one direction or reversible directions.

U.S. Pat. No. 3,550,521 discloses a hollow cylindrical processing tank which oscillates about its axis between a first and a second position to effect processing of the photographic material placed inside the tank. The tank can then be moved to a third position where the used processing solution is drained from the tank.

The oscillating arrangement disclosed in U.S. Pat. No. 3,550,521 has the disadvantage that relatively large volumes of solution are required. This makes this particular arrangement unsuitable for unstable and/or single use processing chemistry.

Co-pending British Patent Application No. 9125297.3 (now published International Patent Application No. W093/11464) discloses a rotating drum arrangement in which low volumes of processing solutions are used allowing unstable and single use chemistry to be efficiently used.

SUMMARY OF THE INVENTION

It is an object of the present invention to provide an oscillating drum arrangement which utilises low volumes of solution.

It is another object of the present invention to provide a processing arrangement of reduced height when part of the drum is cut away.

According to one aspect of the present invention, there is provided photographic processing apparatus for processing photographic material, the apparatus comprising:

a vessel;

a drum mounted within the vessel and defining a processing tank therebetween; and drive means for driving the material being processed through the processing tank relative to the vessel;

characterized in that the drum is oscillated about an axis between a first and a second position to provide the desired agitation of the processing solution.

By this arrangement the advantages of using unstable and/or single use processing chemistry can be utilized.

Preferably, the drum oscillates between an angle of 5° and 90° relative to a vertical plane passing through the axis of the drum.

BRIEF DESCRIPTION OF THE DRAWING

For a better understanding of the present invention, reference will now be made, by way of example only, to the accompanying drawing, the single Figure of which illustrates a drum processor constructed in accordance with the present invention.

DETAILED DESCRIPTION OF THE INVENTION

The arrangement to be described may be the only processing stage of a photographic processor, or it may form one of several similar stages.

In the Figure, a processing tank arrangement 10 is shown and which comprises a generally U-shaped vessel 12 in which is mounted an oscillating drum 14. The drum 14 is mounted to oscillate about an axis 15. A portion 16 of the drum 14, shown in phantom, is cut away to reduce the overall height of the arrangement 10. A small clearance maintained between the vessel 12 and the drum 14 which defines a processing tank 18. Processing solution 20 is contained within the tank 18 to the level indicated by the numeral 22. A pair of drive rollers 24, 26 are positioned at the inlet 28 to the tank arrangement 10. These rollers 24, 26 determine the speed at which photographic material 30 being processed is driven through the tank 18. A second pair of rollers 32, 34 are positioned at the outlet 36 to the tank arrangement 10. These rollers 32, 34 may also be drive rollers and would be driven by the same motor as the first pair of drive rollers 24, 26. Rollers 32, 34 may also be squeegee rollers and function to remove excess processing solution from the material as it leaves the processing tank 18.

The drum 14 is driven by a suitable motor (not shown) which has a reciprocating drive. This allows the drum 14 to oscillate back and forth, about axis 15, up to an angle which lies between 5° and 90° on either side of a vertical plane which passes through the axis 15 of the drum 14. A preferred range of angles through which the drum 14 oscillates is between 5° and 45°. This oscillation gives good agitation dependent on the speed of the motor, but for a speed equivalent to drum rotating in one direction, the agitation caused by the oscillating drum should be the same.

The drum 14 may be sized to accommodate the size of material to be processed. In order to process A4 sized photographic paper, a drum having a diameter of 10 cm and a length of 30 cm can be used. This size of drum can also be used to process A3 sized paper as well as paper sizes smaller than A4. In the case of A3 sized paper, the paper needs to be driven through the tank during processing with its shorter dimension transverse to the direction of movement.

The drum 14 is of circular cross-section, and the portion 16 which is removed (as discussed above) forms a segment thereof. Advantageously, the portion 16 has a cross-section which is less than semi-circular.

Furthermore, the drum 14 may be hollow and have a heater mounted therein for regulating the temperature of the processing solution in the tank18.

The arrangement described above has the advantage that surface area of the agitation device which is coated with processing solution in contact with the air is reduced. This reduces the oxidation and evaporation of the chemicals in the processing solution.

The effects of 'drag' caused by chemicals being carried from one area of the material to the other is localized and reduced due to the increase in turbulence in the processing solution as the drum changes direction as it oscillates.

I claim:

1. Photographic processing apparatus for processing photographic material, the apparatus comprising:

a vessel;

a drum mounted within the vessel and defining a processing tank therebetween; and drive means for driving the material being processed through the processing tank relative to the vessel;

characterized in that the drum is oscillated about an axis between a first and a second position to provide the desired agitation of the processing solution.

2. Apparatus according to claim 1, wherein the drum oscillates an angle of 5° and 90° relative to a vertical plane passing through the axis of the drum.

3. Apparatus according to claim 2, wherein the angle lies between 5° and 45°.

4. Apparatus according to claim 1, wherein the drum has a circular cross-section.

5. Apparatus according to claim 1, wherein the drum is of circular cross-section with a segment removed therefrom.

6. Apparatus according to claim 5, wherein the segment has a cross-section which is less than semi-circular.

* * * * *